United States Patent [19]

Lukkes

[11] Patent Number: 4,990,100

[45] Date of Patent: Feb. 5, 1991

[54] DEVICE FOR SECURING TWO CORDS TOGETHER

[76] Inventor: Dean R. Lukkes, R.R. #1, Box 58A, Bradley, S. Dak. 57217

[21] Appl. No.: 471,269

[22] Filed: Jan. 26, 1990

[51] Int. Cl.[5] ..... H01R 13/62

[52] U.S. Cl. ..... 439/311; 439/588

[58] Field of Search ..... 439/369, 370, 371, 372, 439/373, 311, 588

[56] References Cited

U.S. PATENT DOCUMENTS

| | | | |
|---|---|---|---|
| 1,975,467 | 10/1939 | Livingston | 439/311 |
| 3,167,374 | 1/1965 | Healy | 439/588 |
| 3,945,703 | 3/1976 | McCormick | 439/311 |

FOREIGN PATENT DOCUMENTS

| | | | |
|---|---|---|---|
| 771386 | 4/1957 | United Kingdom | 439/588 |

*Primary Examiner*—Joseph H. McGlynn
*Assistant Examiner*—Hien D. Vu
*Attorney, Agent, or Firm*—Berman, Aisenberg & Platt

[57] ABSTRACT

A device for securing the ends of two electrical cords together includes two base elements. Each of the base elements is attached to a respective end of a cord by a flexible sleeve which extends over the end of the cord. The base elements provide electrical connections which duplicate the original connectors on the ends of the cords. One of the base elements includes a pair of projections which are received in a pair of recesses in a rotatable latch carried by the other of the base elements. The two base elements are held together by the cooperation between the projections and the recesses, and the connection or disconnection is easily accomplished by rotation of the latch. In a second embodiment, the projections and the latch are provided directly on the ends of the cord.

10 Claims, 2 Drawing Sheets

DEVICE FOR SECURING TWO CORDS TOGETHER

TECHNICAL FIELD

This invention relates to the art of electrical cords and is a device for holding the ends of two such cords together.

BACKGROUND ART

A common problem with electrical "extension cords" is that the ends of adjacent cords can be pulled apart easily, thus disconnecting the electric power. One technique for preventing this is to tie the two ends into a knot, but this tends to damage the cords and makes disassembly difficult.

Another technique for securing the ends of two cords together is shown in U.S. Pat. No. 3,316,523 (Trangmar) where an accessory is attached to each of the ends of the cords, and a leaf spring secures the accessories together.

Other devices for securing the ends of two cords together are shown in U.S. Pat. Nos. 3,097,034 (Jamrosy); 4,183,603 (Donarummo); and 4,784,612 (Ryan).

SUMMARY OF THE INVENTION

In accordance with the invention, a device for securing the ends of two cords together comprises two base elements, each of which is attached to a respective one of the two ends to be held together. Each of the base elements provides electrical connectors for engaging the electrical connectors of the end of the cord and additional electrical connections for engaging cooperating electrical connections on the other base.

Each base is removably held to an end of the cord by a gripping means, which is preferably a flexible rubber sleeve. The shape of the rubber sleeve is similar to that of the end of the cord and covers it to hold the base to the cord.

Each base has means for securing it to the other base to secure the ends of the cords together. In a preferred embodiment, the securing means on one of the base elements comprises two radially outward projections, and the cooperating securing means on the other base comprises two recesses for receiving the projections. The recesses are formed in a rotatable latch attached to the other base to allow the projections to be easily captured in the recesses or released.

An object of this invention is to provide two base elements which can be easily attached to respective ends of two electrical cords and secured together to hold the ends of the cords together.

Another object of this invention is to provide base elements which are removably attached to the ends of electrical cords and which may be secured together to hold the ends of the cords together.

DETAILED DESCRIPTION OF THE PREFERRED EMBODIMENT

Figure 1:
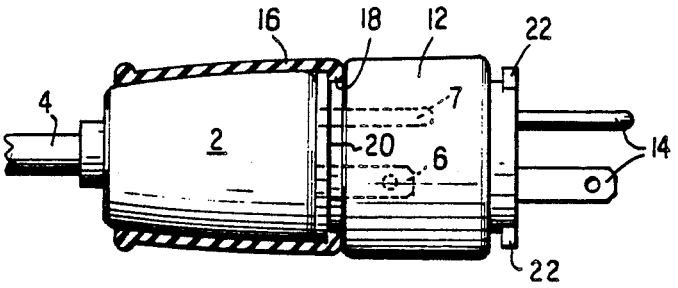
FIG. 1 is a side view of the male end of an electrical cord showing a base of the invention and a gripping means in cross section.
Figure 2:
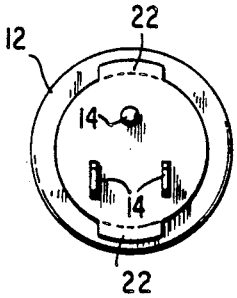
FIG. 2 is an end view of the structure of FIG. 1.

With reference to FIGS. 1 and 2, a male end 2 of an electrical cord 4 includes electrical connectors in the form of blades 6 and an optional grounding prong 7. The blades are normally to be received in female electrical connectors in a female end 8 of a second cord 10, as will be described with reference to FIG. 3.

Figure 3:
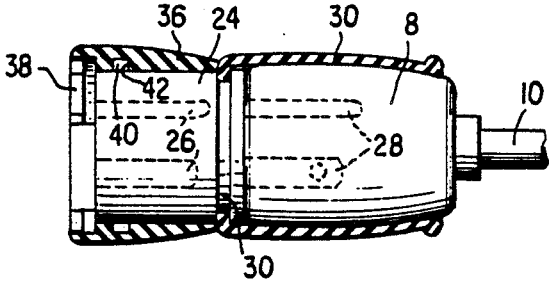
FIG. 3 is a side view of the female end of an electrical cord showing another base of the invention and a rotatable latch and a gripping means in cross section.

In accordance with the invention, a first base element 12 provides female receptacles for receiving the blades 6 and for making electrical contact therewith. The receptacles are electrically connected to a second set of blades and grounding prong 14 which are received in another base element as shown in FIG. 3. The base element 12 is held to end 2 of the cord by a gripping element 16 which is preferably a flexible rubber sleeve. The sleeve includes an inwardly directed rim 18 which engages a groove 20 in the base element. The sleeve 16 could be integral with the base element, depending upon manufacturing choice.

To attach the base 12 to the end 2 of the cord, the sleeve 16 is rolled toward the base, and the blades 6 and prong 7 are inserted into the receptacles in the base 12. The sleeve is then rolled over the end 2 of the cord 4 to hold it to the cord.

Base member 12 includes a pair of radial projections 22 which cooperate with recesses in the other base as will be described in more detail below.

Figure 4:
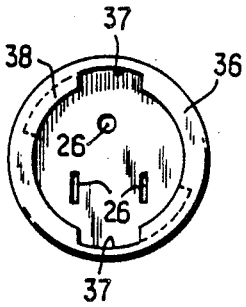
FIG. 4 is an end view of the structure shown in FIG. 3.

With reference to FIGS. 3 and 4, a second base element 24 is attached to the female end of an electrical cord in a similar manner. The second base includes receptacles 26 for receiving blades and ground prong 14 on base 12. The second base has a set of blades and a ground prong 28 electrically connected to the receptacles 26 for being received in the receptacles found in the female end 8 of the cord.

A second gripping means 30 is constructed similarly to gripping element 16 and includes a rim 32 received in a groove 34. The second gripping means is also preferably a flexible rubber sleeve which can be rolled back to allow the second base to be attached to the end 8 and then rolled over the end 8 to secure the second base to the end 8.

The second base carries a latch 36 which provides recesses 38 for cooperating with projections 22 to secure the two base elements, and consequently the two ends of the cords, together. The latch 36 is rotatably mounted to the base 24 and is held in place longitudinally by the cooperation between a ridge 40 on the base and a recess 42 in the latch.

The base elements 12 and 24 are easily attached to the ends of the cords to be secured together by engaging the respective blades and ground prong in the respective receptacles and by rolling the gripping elements over the ends of the cords. The two base elements are then secured together by engaging the blades and ground prong 14 in the receptacles 26, sliding projections 22 through cutouts 37 in latch 36, and by rotating latch 36 with respect to base 24 to engage the projections 22 in the recesses 38. The engagement between the projections 22 and the recesses 38 secures the base elements together, which in turn holds the ends of the cords together because the base elements are held to the ends of the cords by respective gripping elements 16 and 30.

Figure 5:
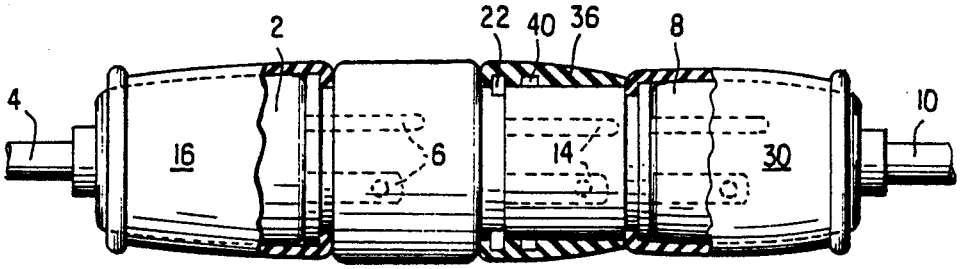
FIG. 5 is a side view of the structures shown in FIGS. 1 and 3 connected to each other.

FIG. 5 shows the completed assembly, with the gripping elements in partial cross section and the latch in cross section.

While the latch is shown attached to the base 24 and the projections a part of base 12, this arrangement can be reversed so that the latch is carried by the base 12 and projections are on the base 24. The materials used are a matter of choice depending, among other considerations, on whether the device is intended for indoor or outdoor use.

Figure 6:
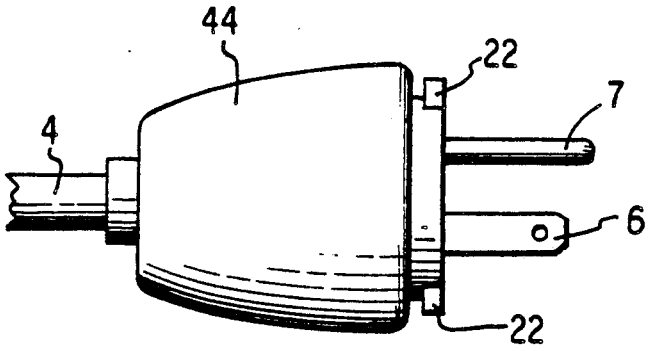
FIG. 6 is a side view of a male end of a cord having integral projections.
Figure 7:
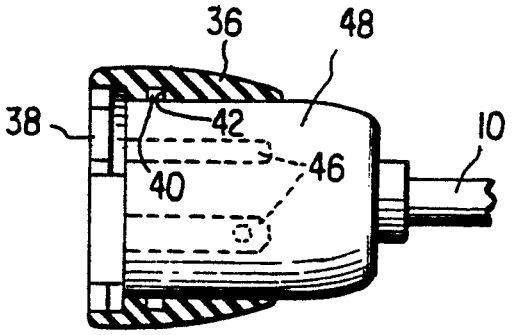
FIG. 7 is a side view of a female end of a cord having an integral latch.

An alternative arrangement is shown in FIGS. 6 and 7. In this embodiment, the securing device is manufactured as a part of the cord itself. Thus, projections 22 are formed as an integral part of male end 44. Blades 6 and ground prong 7 are received in receptacles 46 of female end 48. In this second embodiment, ridge 40 is integral with the female end 48, and latch 36 is mounted thereon for rotation as described above to engage the projections 22. Sleeves 16 and 30 have, accordingly, been eliminated in this embodiment.

It will be appreciated that a unique apparatus for easily securing the ends of two electrical cords together has been described. Modifications within the scope of the appended claims will be apparent to those of skill in the art.

I claim:

1. Apparatus for securing two ends of an electrical cord together wherein each of said ends comprises electrical connectors for engaging electrical connectors of the other of said ends, said apparatus comprising base means for engaging said electrical connectors of one of said ends and for providing electrical connection means connected to said electrical connectors for transmitting electrical power from said one of said ends to the other of said ends, grip means connected to said base means for engaging said one of said ends for holding said base means to said one of said ends, and securing means for securing said base means to a second base means.

2. Apparatus according to claim 1 wherein said grip means comprises a flexible sleeve for covering said one of said ends.

3. Apparatus according to claim 2 wherein said grip means is separate from said base means and comprises a rim for being received in a groove in said base means.

4. Apparatus according to claim 2 further comprising said second base means, second grip means for securing said second base means to another of said ends of said cord, and second securing means for receiving said securing means on said base means.

5. Apparatus according to claim 4 wherein said base means engages electrical blades on said end of said cord, said electrical connection means comprises electrical blades, and said second base means comprises receptacles for receiving said electrical blades.

6. Apparatus according to claim 4 wherein one of said securing means and said second securing means comprises projections and the other of said securing means and said second securing means comprises means providing recesses for receiving said projections.

7. Apparatus for securing two ends of an electrical cord together comprising first securing means on a first of said ends and second securing means on a second of said ends, wherein said first securing means comprises radially directed projections and said second securing means comprises a latch having recesses therein for receiving said projections, wherein said latch is rotatably mounted on said second of said ends and comprises means for retaining said latch on said second end for all rotational positions.

8. Apparatus according to claim 7 wherein said means for retaining comprises a groove which extends in a circumferential direction at least partially around said second of said ends and a ridge which engages said groove.

9. Apparatus according to claim 6 wherein said means providing recesses is a latch rotatably mounted on said second base means.

10. Apparatus according to claim 9 wherein said latch comprises a groove which engages a ridge for mounting said latch on said second base means such that said latch may rotate with respect to said second base means and is retained on said second base means for all rotational positions.

* * * * *